US006256918B1

(12) United States Patent
Szabo

(10) Patent No.: US 6,256,918 B1
(45) Date of Patent: Jul. 10, 2001

(54) FIRING PIN LOCKING ASSEMBLY FOR A SEMI-AUTOMATIC HANDGUN

(76) Inventor: Atilla Szabo, 1 Concorde Place, Toronto, Ontario (CA), PH1 M3C3K6

( * ) Notice: Subject to any disclaimer, the term of this patent is extended or adjusted under 35 U.S.C. 154(b) by 0 days.

(21) Appl. No.: 09/195,557

(22) Filed: Nov. 19, 1998

(51) Int. Cl.[7] ..... F41A 17/66

(52) U.S. Cl. ..... 42/70.08; 42/69.03; 89/147; 89/154

(58) Field of Search ..... 42/70.08, 69.03; 89/150, 154, 147

(56) References Cited

U.S. PATENT DOCUMENTS

| | | | | |
|---|---|---|---|---|
| 984,519 | | 2/1911 | Browning . | |
| 3,724,113 | * | 4/1973 | Ludwig | 42/70.08 |
| 3,830,002 | | 8/1974 | Volkmar | 42/70.08 |
| 4,021,955 | | 5/1977 | Curtis | 42/70.08 |
| 4,312,263 | | 1/1982 | Bourlet | 42/70.08 |
| 4,555,861 | | 12/1985 | Khoury | 42/70.08 |
| 5,157,209 | * | 10/1992 | Dunn | 42/70.08 |
| 5,666,754 | * | 9/1997 | De Oliveira Masina | 42/70.08 |

FOREIGN PATENT DOCUMENTS

| | | | | |
|---|---|---|---|---|
| 304280 | * | 3/1920 | (DE) | 42/70.08 |

* cited by examiner

*Primary Examiner*—Stephen M. Johnson
(74) *Attorney, Agent, or Firm*—Finnegan, Henderson, Farabow, Garrett & Dunner, L.L.P.

(57) ABSTRACT

A semi-automatic handgun that includes a firing pin locking assembly is disclosed. The firing pin locking assembly includes a firing pin plunger that has a locked position and an unlocked position. In the locked position, the firing pin plunger locks the firing pin in place. A trigger assembly is provided to selectively move the firing pin plunger to the unlocked position, where the firing pin plunger is disengaged from the firing pin. The trigger assembly is also operable to release the firing pin plunger to allow the firing pin plunger to be biased into the locked position after each round is fired.

21 Claims, 16 Drawing Sheets

FIRING PIN LOCKING ASSEMBLY FOR A SEMI-AUTOMATIC HANDGUN

BACKGROUND OF THE INVENTION

The present invention relates to a safety mechanism for a semi-automatic handgun. More particularly, the invention relates to a firing pin locking assembly.

Accidental firings of semi-automatic handguns pose a danger risk for handgun owners. Handgun designers and manufacturers are continuously attempting to design new and improved safety devices that will decrease the danger risk of handguns by preventing accidental firings. Many different aspects of handgun operation readily lend themselves to safety devices.

The operation of the firing pin is one such aspect. In a typical semi-automatic handgun, a round is fired by bringing the firing pin into contact with a chambered round. The physical contact between the firing pin and the round causes the discharge of the round. To create the contact with the round, a hammer strikes the firing pin, which is slidably mounted in a slide, and pushes the firing pin into contact with the round. Allowing the firing pin to move freely within the slide could potentially result in an accidental discharge of the handgun. Thus, a safety device that locks the firing pin in place until the trigger is pulled can eliminate several potential safety hazards.

Firing pin locking devices for semi-automatic handguns are known in the art. U.S. Pat. No. 4,555,861 to Khoury discloses one example of such a firing pin locking device. However, the known devices, like the one disclosed in U.S. Pat. No. 4,555,861, do not completely eliminate the possibility of accidental firings.

The known firing pin locks work in conjunction with trigger assemblies to lock the firing pin in place until the trigger is pulled. The firing pin lock is positioned in the slide and is directly connected to the trigger. Pulling the trigger releases the hammer and causes the firing pin lock to disengage from the firing pin so the firing pin can move within the slide. The hammer strikes the firing pin to thereby fire a round. The recoil action of the fired round causes the slide to move rearwardly to extract the spent round. The slide then returns to the forward position and chambers the next round to be fired.

The safety concern with such prior art safety devices occurs when the trigger remains in the pulled position after the round is fired. Because the known firing pin locks have a direct connection to the trigger, the firing pin locks do not re-engage the firing pin until the trigger is released. Thus, when the slide moves forward to move the next round into the chamber, the firing pin remains unlocked unless the trigger is released. The forward momentum of the slide and firing pin could potentially result in the firing pin striking the recently chambered round, thereby initiating an accidental shot.

This scenario could repeat on each successive round until the trigger is released. Consequently, the handgun could potentially fire automatically because the firing pin lock does not re-engage the firing pin until the trigger is released. Thus, a handgun that was not intended to be fired automatically could become automatic if the trigger remains pulled or otherwise jams.

In light of the foregoing there is a need for a firing pin locking device for a semi-automatic weapon that locks the firing pin after each round is fired, regardless of the trigger position.

SUMMARY OF THE INVENTION

The present invention is directed to a semi-automatic handgun. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a semi-automatic handgun comprising a frame having a sear pin, a hammer pin, a safety pin, and a trigger. A slide is mounted on the frame and can slide between forward and rearward positions. A firing pin is slidably disposed in the slide. There is provided a firing pin plunger that has a locked position and an unlocked position. In the locked position, the firing pin plunger engages the firing pin. In the unlocked position, the firing pin plunger is disengaged from the firing pin. A plunger spring is provided to bias the firing pin plunger into the locked position. There is also provided a trigger assembly mounted in the frame. The trigger assembly moves the firing pin plunger to the unlocked position when the trigger is pulled and subsequently releases the firing pin plunger after each round is fired regardless of the position of the trigger. The release of the firing pin plunger allows the plunger spring to urge the firing pin plunger into the locked position.

According to another aspect, the invention is directed to a firing pin locking assembly for a semi-automatic handgun including a frame having a trigger and a slide. The assembly comprises a firing pin slidably mounted in the slide. There is provided a firing pin plunger that has a locked position and an unlocked position. In the locked position, the firing pin plunger engages the firing pin. In the unlocked position, the firing pin plunger is disengaged from the firing pin. A plunger spring is provided to bias the firing pin plunger into the locked position. There is also provided a trigger assembly mounted in the frame. The trigger assembly moves the firing pin plunger to the unlocked position when the trigger is pulled and subsequently releases the firing pin plunger after each round is fired regardless of the position of the trigger. The release of the firing pin plunger allows the plunger spring to urge the firing pin plunger into the locked position.

In another aspect, the invention is directed to a firing pin lock assembly for a semi-automatic handgun. The assembly comprises a locking means for locking the firing pin in place. There is provided a trigger assembly for selectively disengaging the locking means from the firing pin. The trigger assembly enables the locking means to automatically lock the firing pin after each round is fired.

In still another aspect, the invention is directed to a semi-automatic handgun comprising a frame having a trigger. A slide is mounted on the frame for sliding movement. A firing pin is mounted in the slide and is operable to contact a chambered round of ammunition to fire the round. There is provided a firing pin plunger that is moveable between a locked position where the firing pin plunger locks the firing pin and an unlocked position where the firing pin is free to move into contact with the chambered round to fire the round. The firing pin plunger is normally biased into the locked position. There is also provided a trigger assembly that, in response to movement of the trigger, selectively disengages the firing pin plunger from the locked position and holds the plunger in the unlocked position. The trigger assembly is operable to release the plunger from the unlocked position to thereby lock the firing pin in response to movement of the slide subsequent to the firing of the chambered round.

According to another aspect, the present invention is directed to a semi-automatic handgun comprising a frame having a trigger. A slide is mounted on the frame for sliding movement. A firing pin is mounted in the slide and is operable to contact a chambered round of ammunition to fire the round. There is provided a firing pin plunger that is moveable between a locked position where the firing pin plunger locks the firing pin and an unlocked position where the firing pin is free to move into contact with the chambered round to fire the round. There is also provided a plunger operating mechanism that is selectively movable between a safe position and a firing position in response to a movement of the trigger. The movement of the plunger operating mechanism from the safe position to the firing position causes the firing pin plunger to move from the locked position to the unlocked position. There is further provided a disconnect that is operably connected between the drawbar and the plunger operating mechanism. The recoil action of the slide moves the disconnect to disrupt the connection between the plunger operating mechanism and the drawbar to thereby allow the plunger operating mechanism to return to the safe position.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DETAILED DESCRIPTION

Reference will now be made in detail to the preferred embodiments of the present invention, examples of which are illustrated in the accompanying drawings. Wherever possible, the same reference numbers will be used throughout the drawings to refer to the same or like parts.

In accordance with the present invention, a semi-automatic handgun is provided. There is disclosed by way of example a model 1911A1 semi-automatic handgun. The 1911A1 model handgun is disclosed in U.S. Pat. No. 984,519, which is hereby incorporated by reference. U.S. Pat. No. 984,519 discloses the overall structure and operation of the 1911A1 model handgun and its disclosure of the basic structural components and operation will not be repeated.

Figure 1:
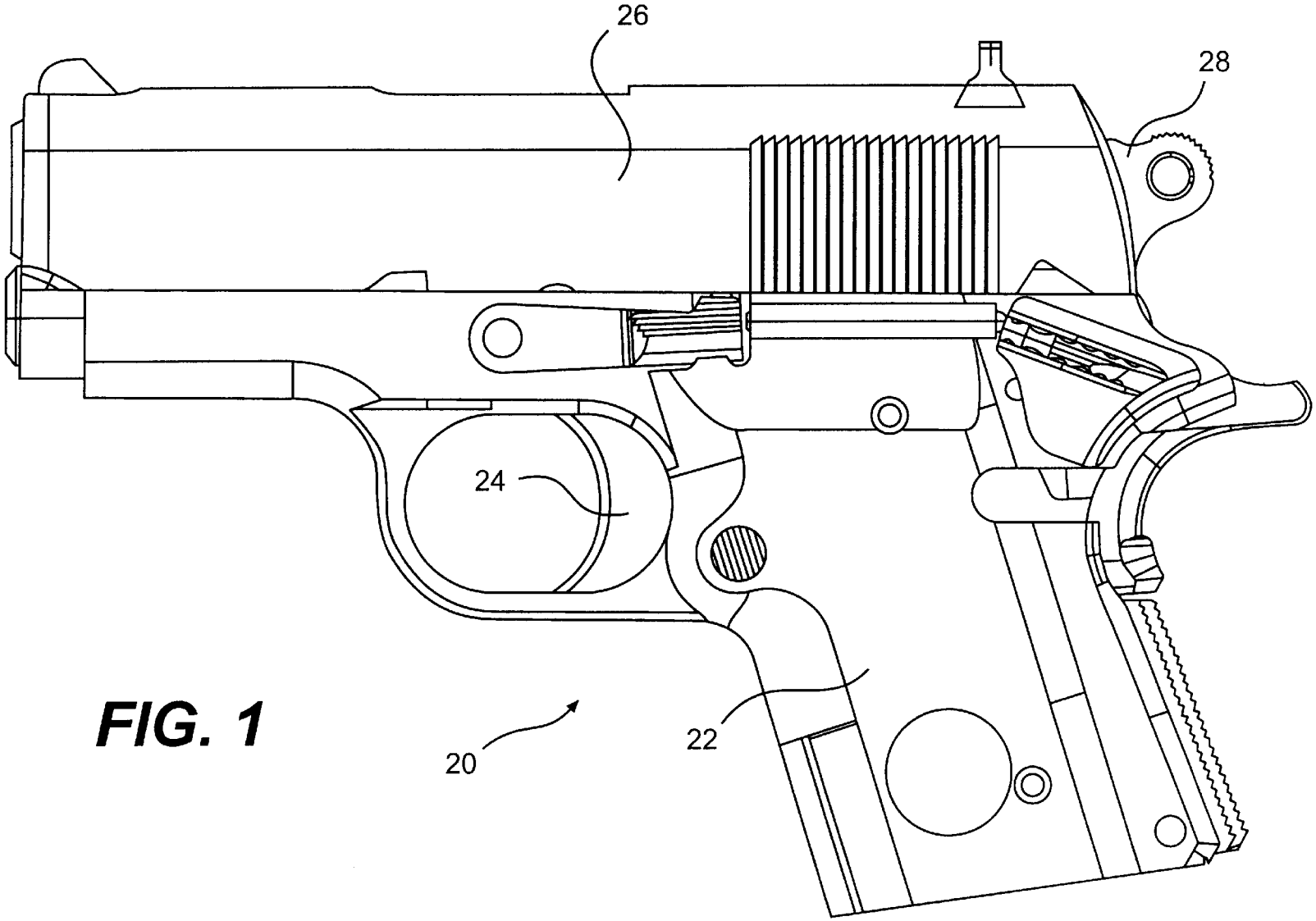
FIG. 1 is a side pictorial view of a handgun of the present invention.

A 1911A1 model handgun is shown in FIG. 1 and is designated generally by reference number 20. As illustrated in FIG. 1, the model 1911A1 handgun 20 has a slide 26 mounted on frame 22. The slide 26 slides along frame 22 longitudinally between a forward position (as illustrated) and a rearward position. A trigger 24 is also slidably mounted on the frame 22. The trigger 24 slides within frame 22 from a forward position (as illustrated) to a rearward position.

Figure 2:
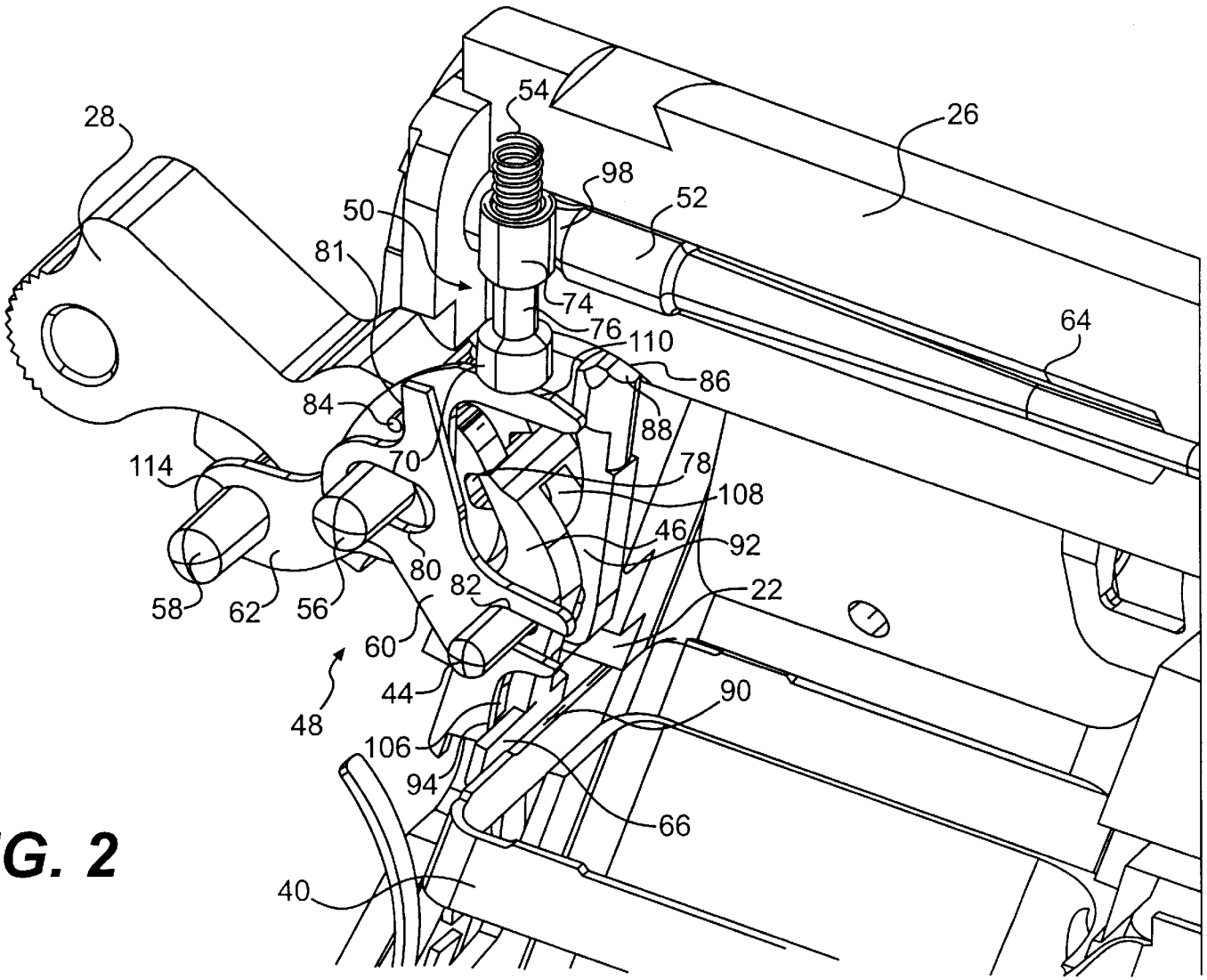
FIG. 2 is a pictorial view of a firing pin locking assembly of the present invention.

As shown in FIG. 2, a hammer 28 is rotatably mounted on hammer pin 56. The hammer 28 is positioned to rotate into contact with firing pin 52. The firing pin 52 slides in groove 64 within slide 26. The firing pin 52 moves forwardly in groove 64 to strike a chambered round (not shown). The contact between the firing pin and the chambered round results in a shot being fired.

In accordance with the present invention, a firing pin plunger is provided to lock the firing pin in place. The firing pin plunger is moveable between a locked position and an unlocked position. The firing pin is normally biased into the locked position, where the firing pin plunger is engaged with the firing pin. In the unlocked position, the firing pin plunger is disengaged from the firing pin. The firing pin plunger provides a means for preventing the firing pin from moving relative to the slide.

Figure 3:
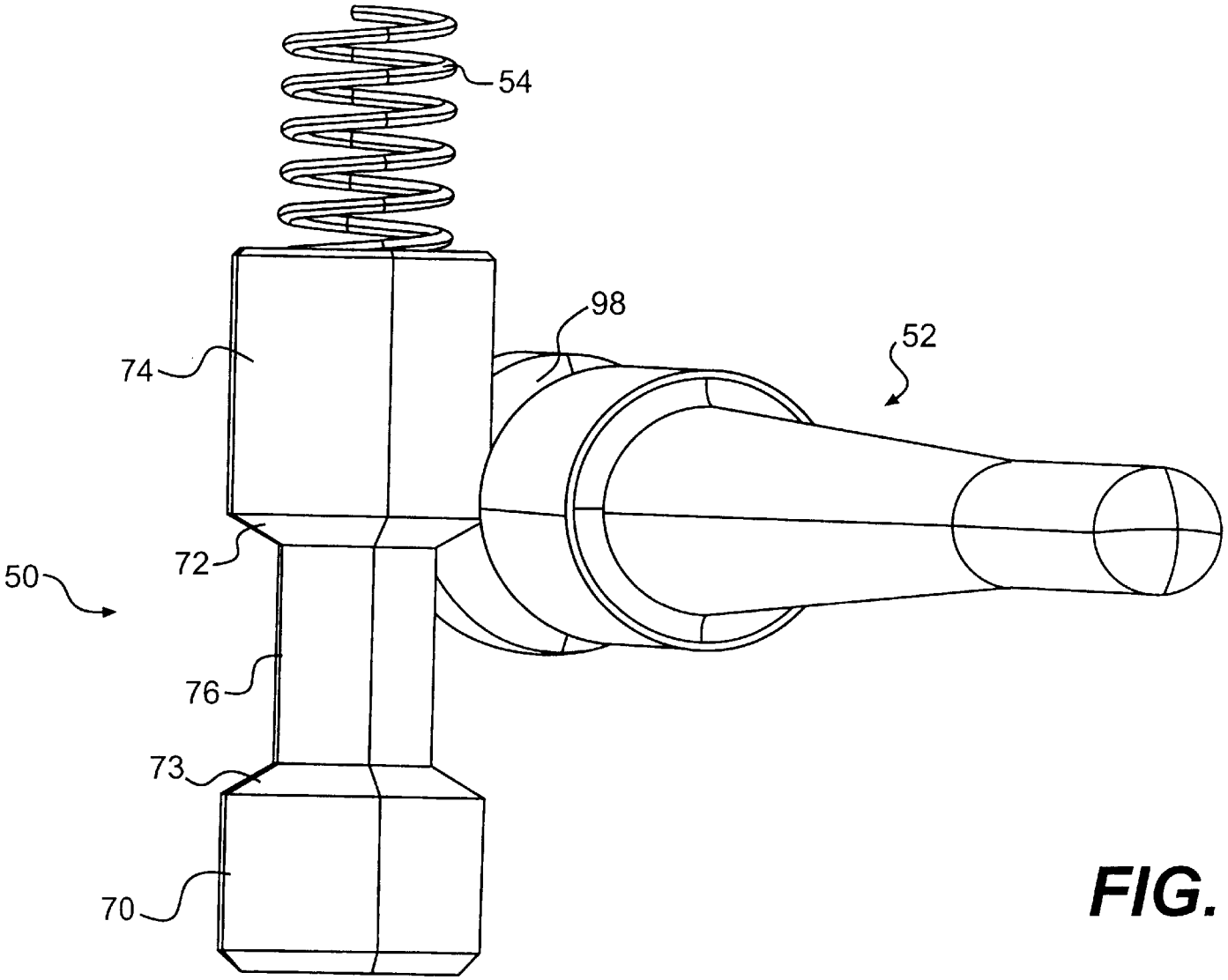
FIG. 3 is a pictorial view of a firing pin lock of the present invention, illustrating the locked position.

As embodied herein and as best illustrated in FIG. 2, the firing pin plunger 50 is slidably mounted in slide 26. The firing pin plunger 50 is biased downwardly by plunger spring 54. The plunger spring 54 acts on the top section 74 of the firing pin plunger 50. The firing pin plunger 50 also has a middle section 76 and a bottom section 70. The middle section 76 is narrower than the top and bottom sections. As illustrated in FIG. 3, two beveled sections 72 and 73 connect the middle section 76 to the wider top and bottom sections 74 and 70, respectively.

In the locked position, the top section 74 of the firing pin plunger 50 engages a groove 98 in the firing pin 52. The engagement of the top section 74 and groove 98 locks the firing pin 52 in place, relative to the slide 26 (referring to FIG. 2). The downward bias of plunger spring 54 acts on the firing pin plunger 50 to engage the top section 74 and groove 98.

Figure 4A:
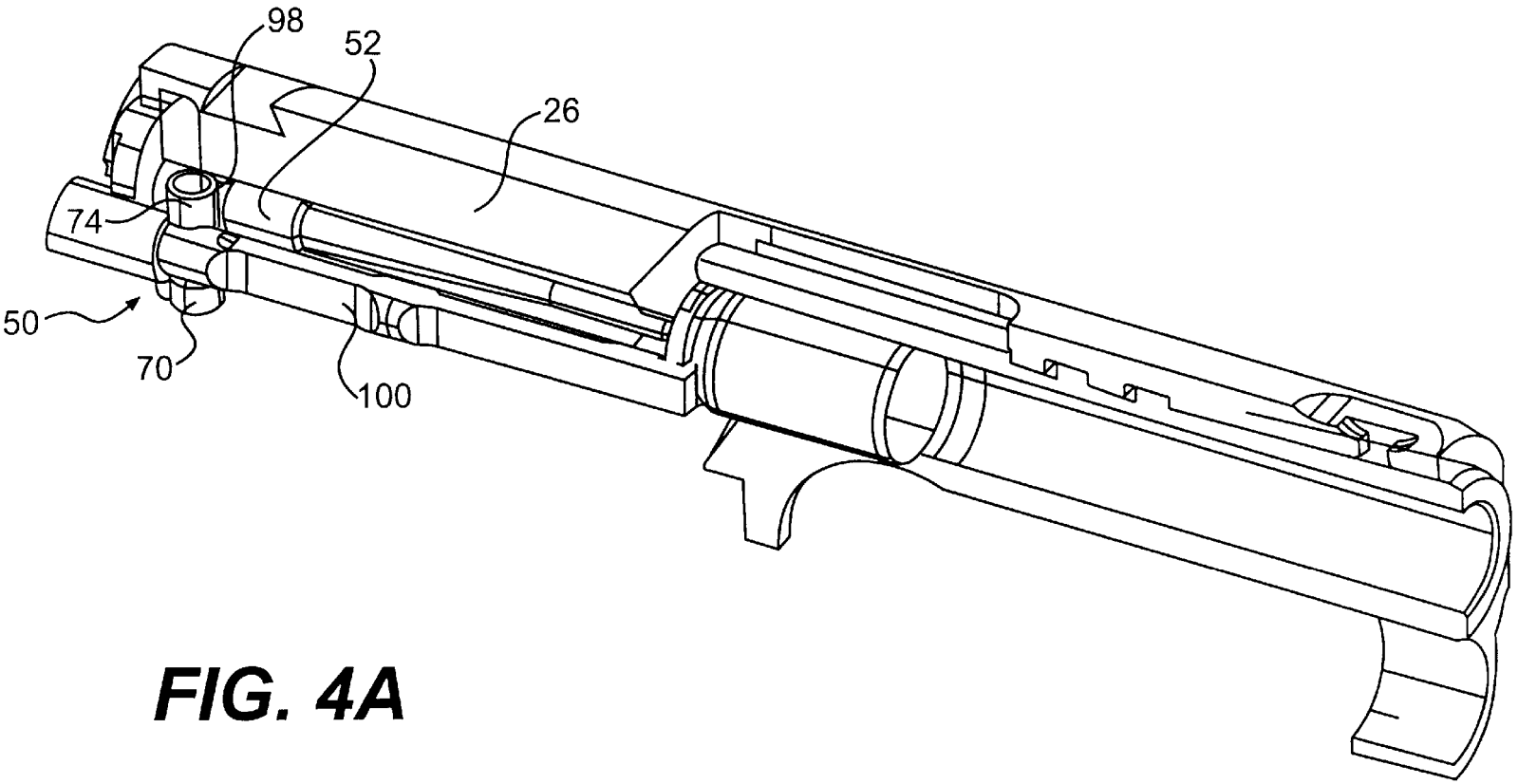
FIG. 4*a* is a pictorial view of a slide assembly of the present invention.
Figure 4B:
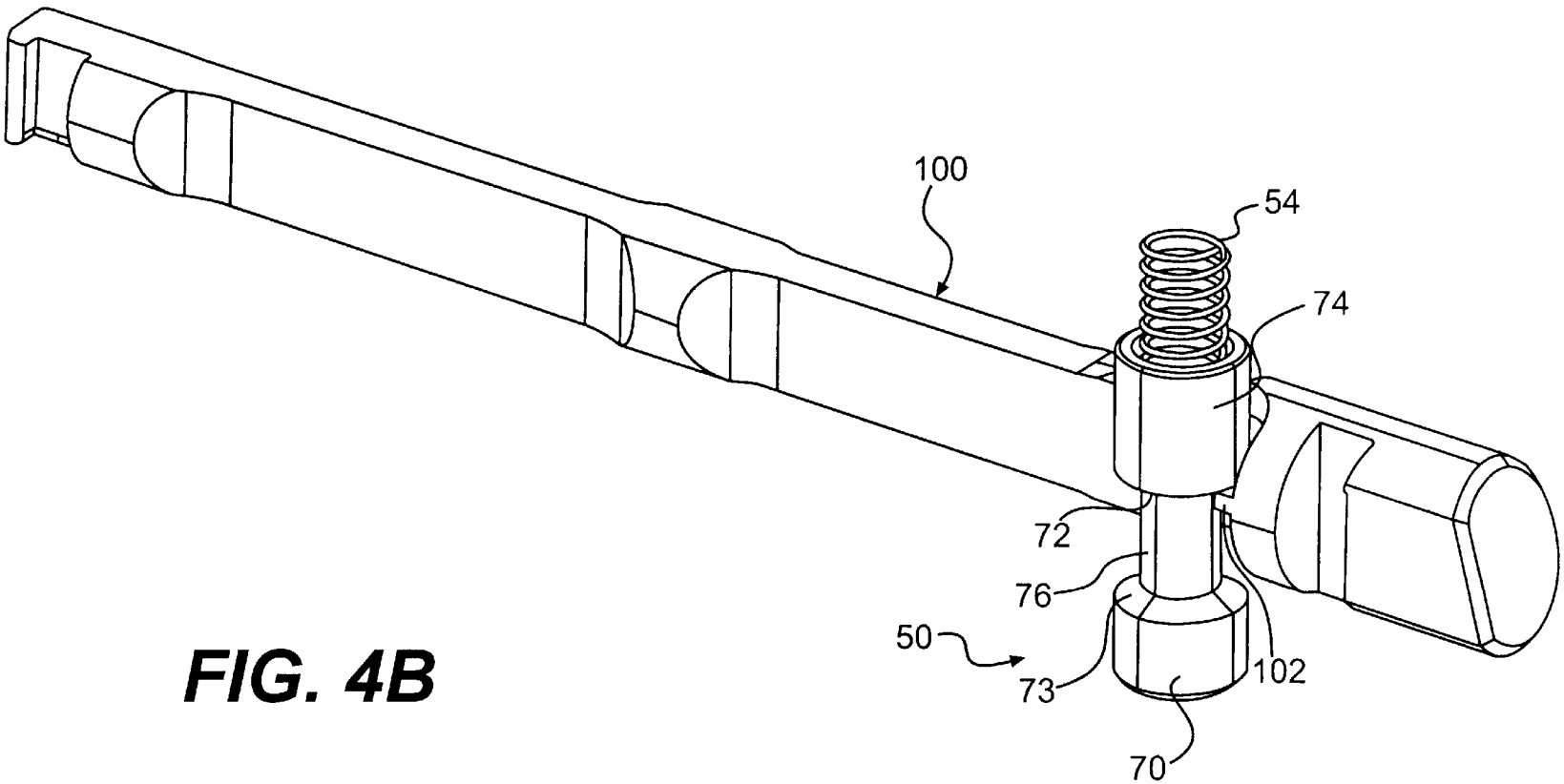
FIG. 4*b* is a pictorial view of a firing pin plunger and extractor of the present invention.

As shown in FIG. 4*a,* the firing pin plunger 50 is preferably positioned between the firing pin 52 and an extractor 100. As illustrated in FIG. 4*b,* the extractor 100 has a ledge 102. The downward bias of plunger spring 54 acts to move the upper beveled section 72 of the firing pin plunger 50 into contact with ledge 102. The ledge 102 is positioned so that when the upper beveled section 72 is in contact with ledge 102, the top section 74 of the firing pin plunger 50 is engaged with the firing pin 52. In this manner, the firing pin plunger 50 is maintained in the locked position.

Figure 5:
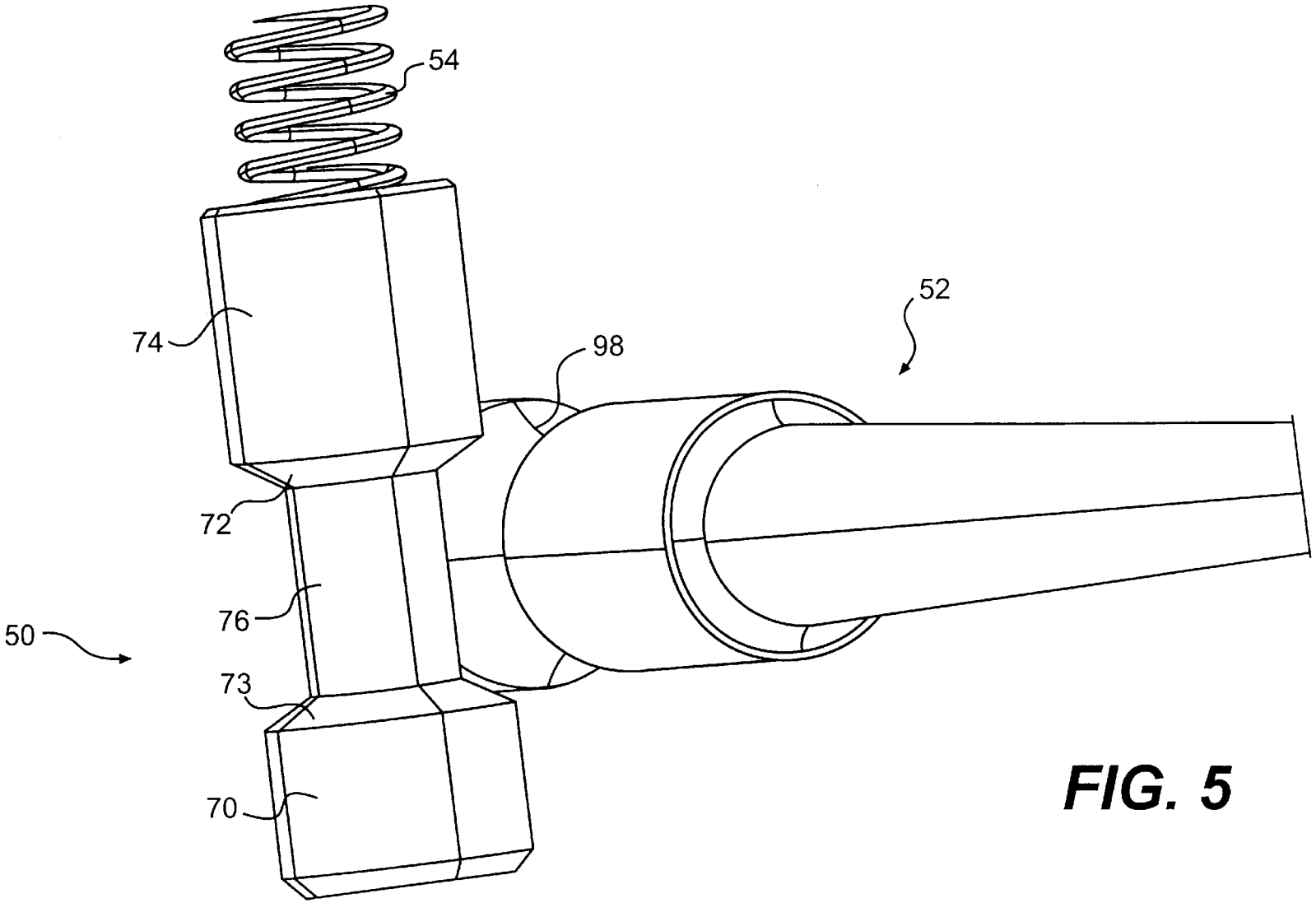
FIG. 5 is a pictorial view of the firing pin lock of FIG. 3 illustrating the unlocked position.

As shown in FIG. 5, an upward movement of the firing pin plunger 50 results in the compression of the plunger spring 54 and the disengagement of the top section 74 from the groove 98. When the narrow middle section 76 of the firing pin plunger 50 becomes aligned with the groove 98 of the firing pin 52, no part of the firing pin plunger 50 contacts the firing pin 52. Thus, the firing pin plunger 50 is disengaged from the firing pin 52 by moving the firing pin plunger 50 upwardly until the middle section 76 is aligned with the firing pin 52. In this unlocked position, the firing pin 52 is free to slide within the slide 26.

In accordance with the present invention, a trigger assembly is provided. The trigger assembly is operable to selectively move the firing pin plunger from the locked position to the unlocked position. The trigger assembly is further operable to release the firing pin plunger in response to the rearward motion of the slide.

In the exemplary embodiments, the disclosed handgun is single action. It is contemplated that the present invention may also be used in conjunction with a conventional double action handgun, as well as a double action only handgun.

As embodied herein and as illustrated in FIG. 2, the handgun of the present invention includes a trigger assembly (designated generally as 48) operably connected to a trigger 24. The trigger assembly 48 includes a drawbar 40 slidably mounted in frame 22. The drawbar 40 is connected to the trigger 24 (referring to FIG. 1). The rearward motion of the trigger 24 results in a corresponding rearward motion of drawbar 40. Although the presently preferred embodiment utilizes an axial moving trigger, it is contemplated that alternative embodiments of the subject invention may be utilized with pivoting triggers.

Figure 6:
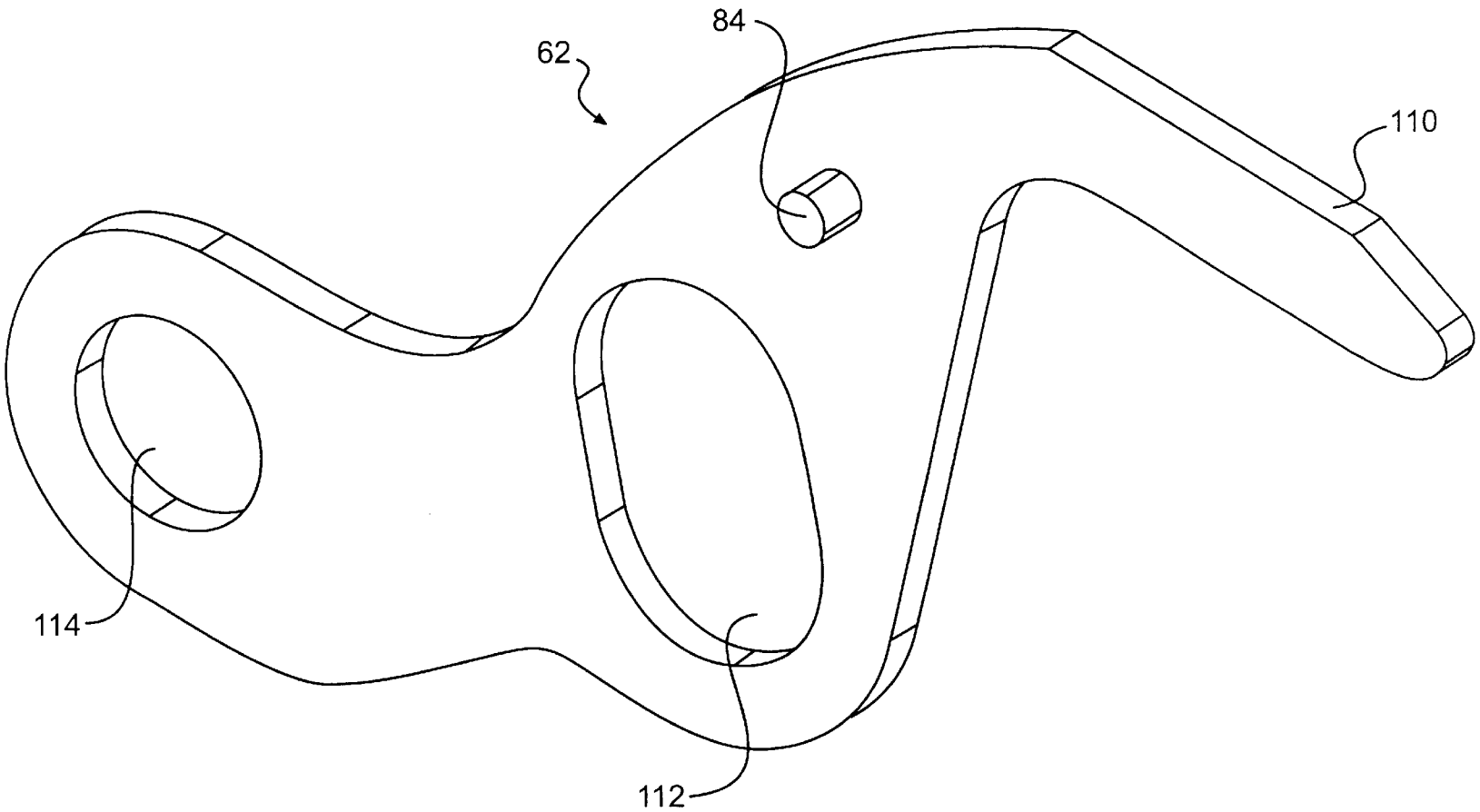
FIG. 6 is a pictorial view of a plunger lever of the present invention.

In one preferred embodiment illustrated in FIGS. 2, 6, and 9–12, the trigger assembly 48 has a plunger support that includes a plunger lever 62 and a slide plate 60. As illustrated in FIG. 6, the plunger lever 62 has a bore 114, a slot 112, and a lever arm 110. As illustrated in FIG. 2, the bore 114 engages the safety pin 58, thereby allowing the plunger lever 62 to rotate about the safety pin 58. Slot 112 engages the hammer pin 56. The dimensions of the slot 112 limit the range of rotation of the plunger lever 62. The upward rotation of the plunger lever 62 causes the lever arm 110 to move upwardly into contact with the bottom section 70 of firing pin plunger 50.

Figure 9:
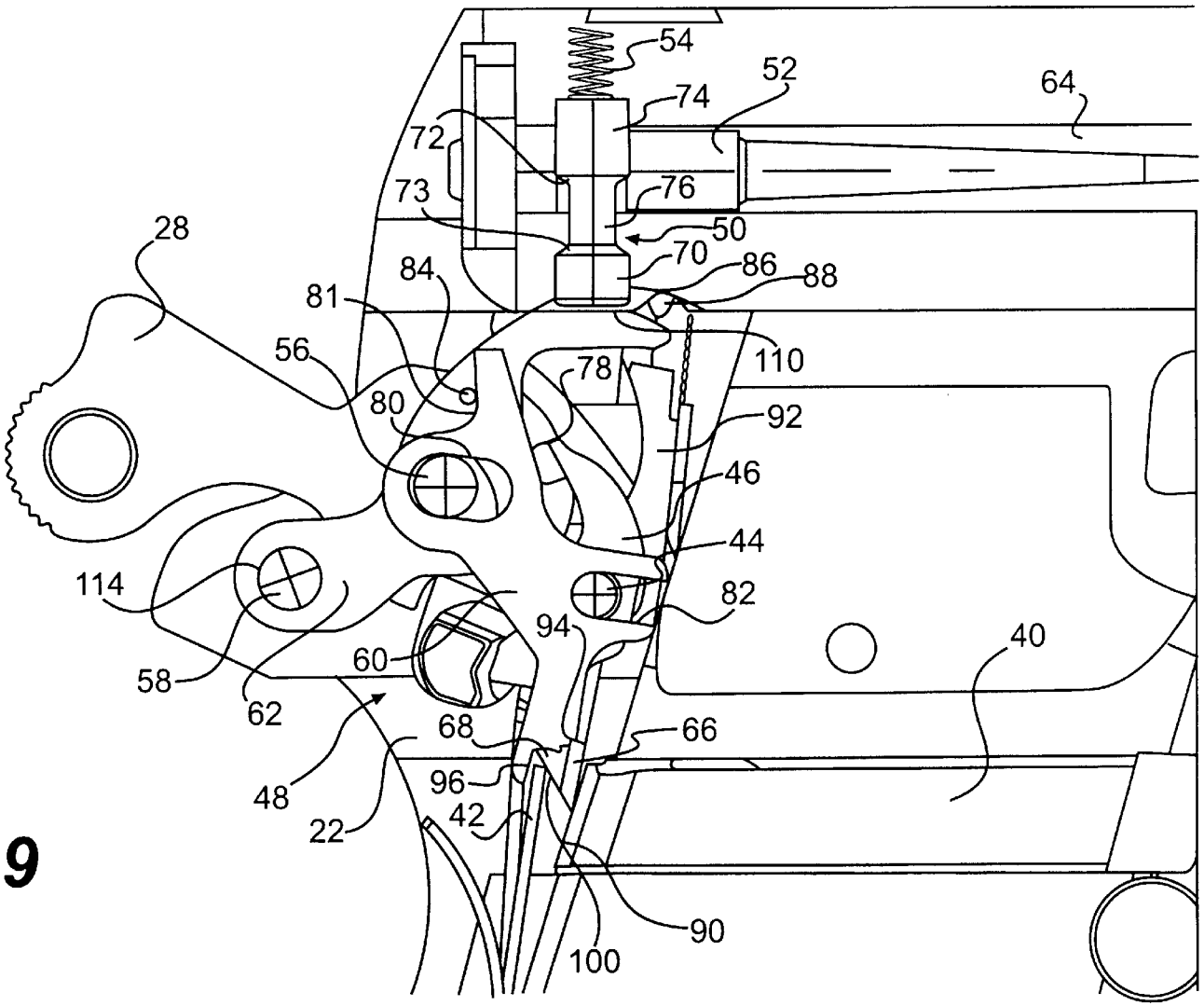
FIG. 9 is a side view of a firing pin locking assembly of the present invention.

As shown in FIG. 2, the plunger lever 62 also has a pin 84. The pin 84 engages a cam 81 on slide plate 60. The slide plate 60 includes a groove 82 and a slot 80. In the preferred embodiment, the groove 82 engages sear pin 44 and the slot 80 engages hammer pin 56. This arrangement is best shown in FIG. 9. The width of each of the groove 82 and slot 80 are preferably substantially the same as the diameter of the sear pin 44 and hammer pin 56, respectively. This sizing restricts the slide plate 60 to axial movement.

Figure 13:
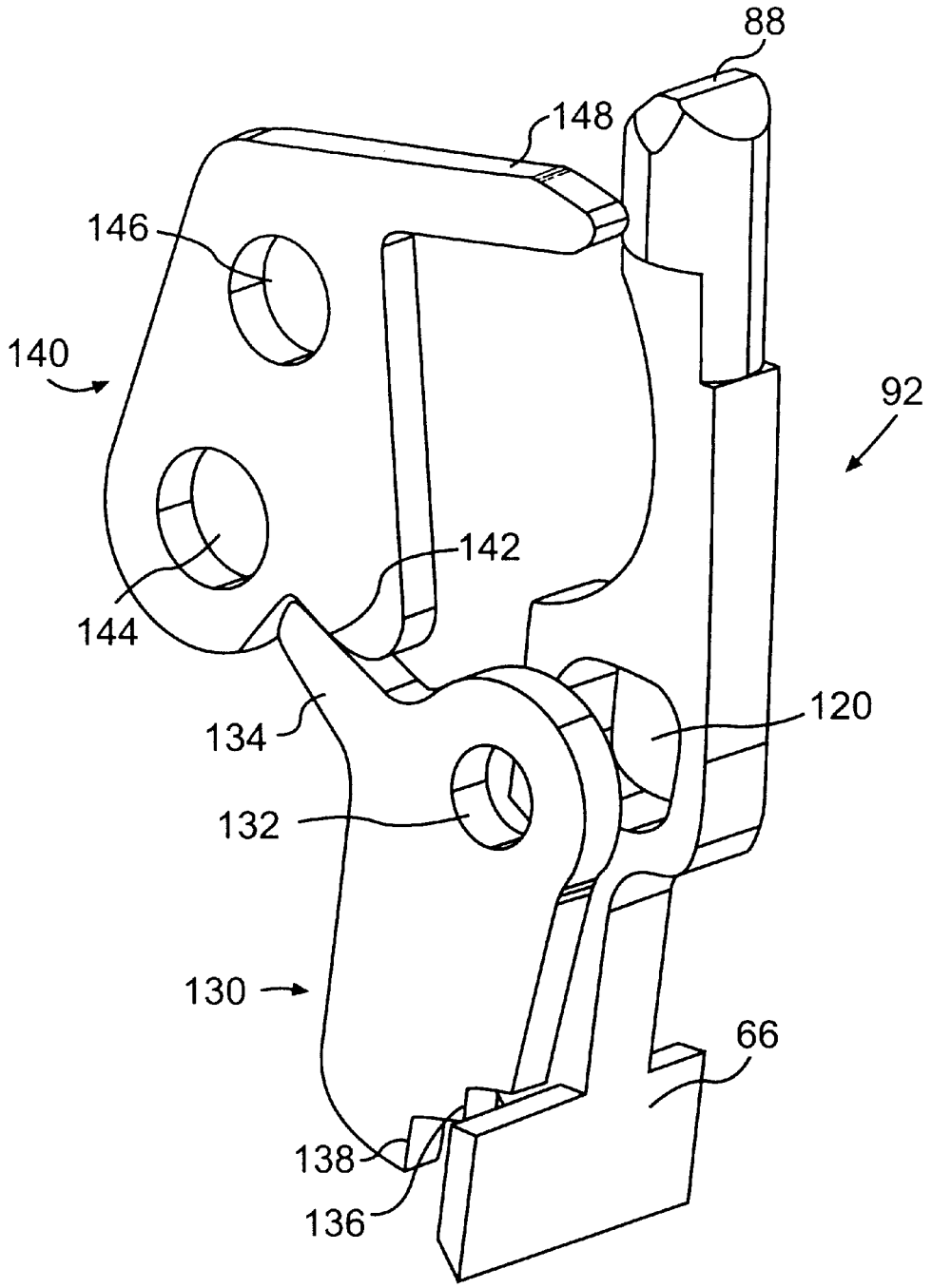
FIG. 13 is a pictorial view of an alternative embodiment of a plunger support of the present invention.

In a second preferred embodiment of the present invention and as illustrated in FIGS. 13–16, the plunger support of trigger assembly 48 includes a first lever 140 and a second lever 130. In this embodiment and as illustrated in FIG. 13, first lever 140 has a support surface 142, a bore 144, a work hole 146, and a lever arm 148. Bore 144 engages hammer pin 56, thereby allowing first lever 140 to pivot about hammer pin 56. When first lever 140 rotates upwardly, lever arm 148 contacts bottom section 70 of firing pin plunger 50.

As also shown in FIG. 13, second lever 130 includes a support arm 134, a bore 132, a first lower surface 136, and a second lower surface 138. Bore 132 engages sear pin 44, thereby allowing second lever 130 to pivot about sear pin 44. Support arm 134 engages support surface 142 of first lever 140. With this engagement, a pivoting motion of second lever 130 results in a corresponding pivoting motion of first lever 140.

In accordance with the present invention, the trigger assembly further includes the handgun disconnect. The disconnect provides a means of releasing the firing pin plunger subsequent to each fired round to thereby allow the biasing force of spring 54 to urge the plunger downwardly into a locked position.

As embodied herein and as best illustrated in FIG. 2, a disconnect member 92 is operably engaged with slide 26, as well as slide plate 60 and trigger drawbar 40. The disconnect member 92 has a slide contact 88 that engages a cam surface 86 in the slide 26. The slide cam 86 acts to move the disconnect member 92 generally downward within a cavity.

Figure 7:
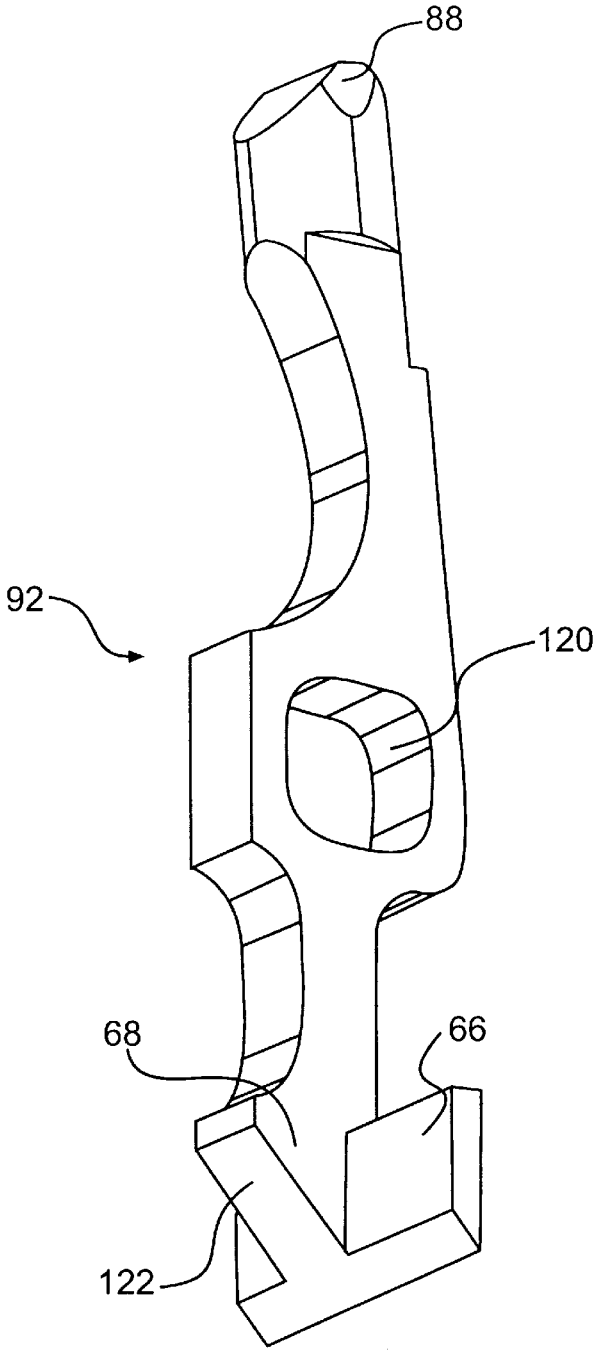
FIG. 7 is a pictorial view of a disconnect member of the present invention.

The disconnect member 92 is preferably mounted on sear pin 44. As shown in FIG. 7, the disconnect member 92 has a bore 120. The bore 120 engages the sear pin 44. The bore 120 is rectangularly shaped so the disconnect member may move longitudinally and vertically on the sear pin 44.

The disconnect member 92 also has a paddle 66. As shown in FIG. 2, the paddle 66 is positioned between a rear edge 90 of drawbar 40 and a lower edge 94 of the slide plate 60. A rearward motion of the drawbar 40 results in a corresponding rearward motion of paddle 66 and slide plate 60.

Figure 8:
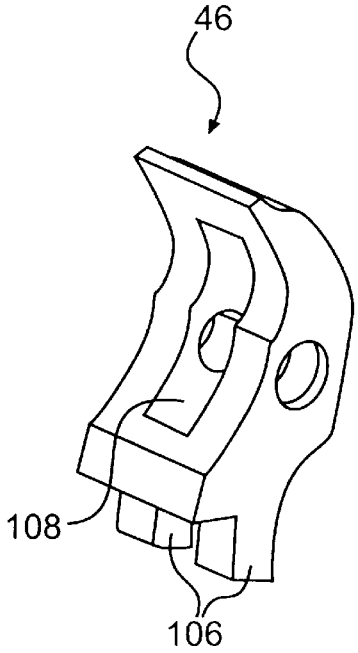
FIG. 8 is a pictorial view of a sear of the present invention.

The paddle 66 also contacts sear prongs 106. As shown in FIG. 8, the sear 46 has a hollow section 108 and two prongs 106. As shown in FIG. 2, the sear 46 is rotatably mounted on sear pin 44. The disconnect member 92 is positioned within the hollow section 108 so that the paddle 66 abuts the prongs 106 of sear 46. A rearward motion of the paddle 66 causes the sear 46 to rotate about sear pin 44.

As shown in FIG. 9, a leaf spring 42 abuts spring contact 68 of the disconnect member 92. The spring contact 68 has an angled edge 122 to split the force of leaf spring 42. The shape of the spring contact 68 divides the force of the leaf spring 42 into two directions: a generally vertical force on the disconnect member 92 and a longitudinal force on the paddle 66 of the disconnect member 92. The longitudinal force is transferred through the paddle 66 to the drawbar 40. Thus, the leaf spring 42 acts to bias the disconnect member upwardly against the slide cam 86 and acts to bias the drawbar 40 to its forward position.

The operation of the aforementioned device will now be described with reference to the attached drawings. With respect to a first preferred embodiment, as illustrated in FIGS. 2 and 9, the operation of the handgun of the disclosed embodiment begins with the handgun in the cocked position. The handgun of the disclosed embodiment is single action and thus, the hammer must be manually cocked prior to firing the first round. In a double action handgun, the trigger pull would cock the hammer and fire the handgun in the same action. In a double action handgun, the present invention would function as described after the hammer was moved to the cocked position.

In the cocked position as illustrated in FIG. 9, the sear 46 engages the cocked notch 78 of the hammer 28. The drawbar 40 and slide 26 are in their forward positions with respect to the frame 22. The slide plate 60 is positioned forward on the hammer pin 56 and sear pin 44. The firing pin plunger 50 is in the locked position, where top section 74 of the firing pin plunger 50 engages the groove 98 in the firing pin 52. In this position, the firing pin plunger 50 locks the firing pin 52 in place, preventing the firing pin 52 from moving forward with respect to the slide 26.

Figure 10:
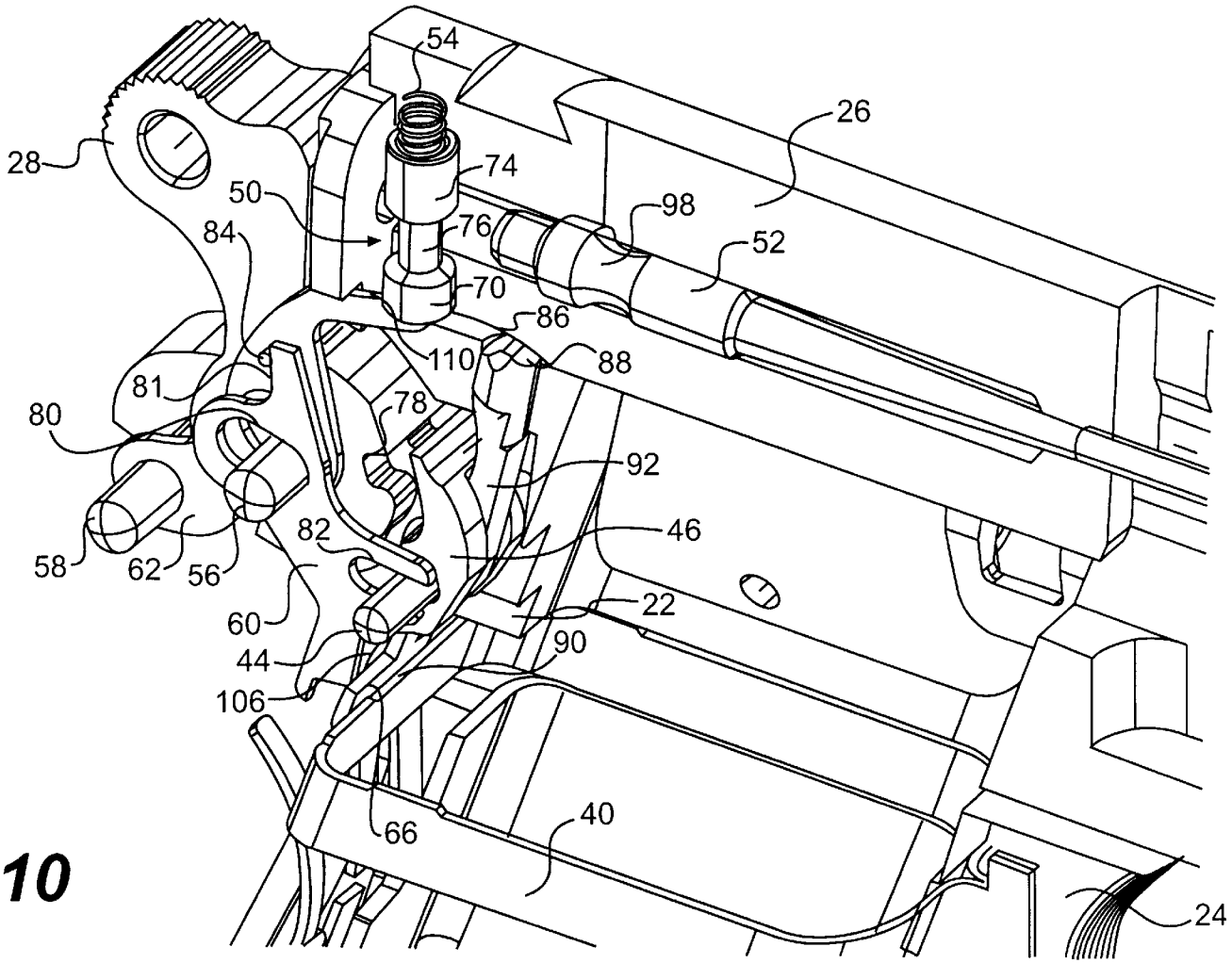
FIG. 10 is a pictorial view of the firing pin locking assembly of FIG. 9, illustrating the firing position.

As illustrated in FIG. 10, when the trigger 24 is pulled rearwardly, the drawbar 40 moves rearwardly with respect to frame 22. The drawbar 40 moves the paddle 66 of the disconnect member 92 rearwardly. The rearward motion of the paddle 66 compresses the leaf spring 42 (referring to FIG. 9), moves the slide plate 60 rearwardly, and rotates the sear 46.

The rearward motion of the slide plate 60 is guided by slot 80 and groove 82 to ensure a generally longitudinal movement. The generally longitudinal rearward movement causes the slide plate cam 81 to act on the plunger lever pin 84. The result is an upward rotation of plunger lever 62 about the safety pin 58. The upward rotation of the plunger lever 62 causes the lever arm 110 to contact the bottom section 70 of the firing pin plunger. The shape of the slot 112 engaging the hammer pin 58 limits the rotation range of lever arm 110. The upward motion of the firing pin plunger 50 compresses the plunger spring 54 and moves the firing pin plunger 50 into the unlocked position where the top section 74 of the firing pin plunger 50 is out of engagement with the groove 98 in the firing pin 52. The slot 112 is sized so that the lever arm will move the firing pin plunger 50 until the narrow middle section 76 is aligned with the firing pin 52 as illustrated in FIG. 5. Thus, the firing pin plunger 50 is moved out of engagement with the firing pin 52.

In addition to moving the slide plate 60, the paddle 66 also rotates sear 46 about the sear pin 44. The rotation of the sear 46 moves it out of engagement with the hammer 28. The hammer 28 is then acted upon by a hammer spring (not shown) and the hammer 28 rotates forward to strike the firing pin 52. The contact with the hammer 28 moves the firing pin 52 forward and into contact with a chambered round (not shown) thereby firing the round.

Figure 11:
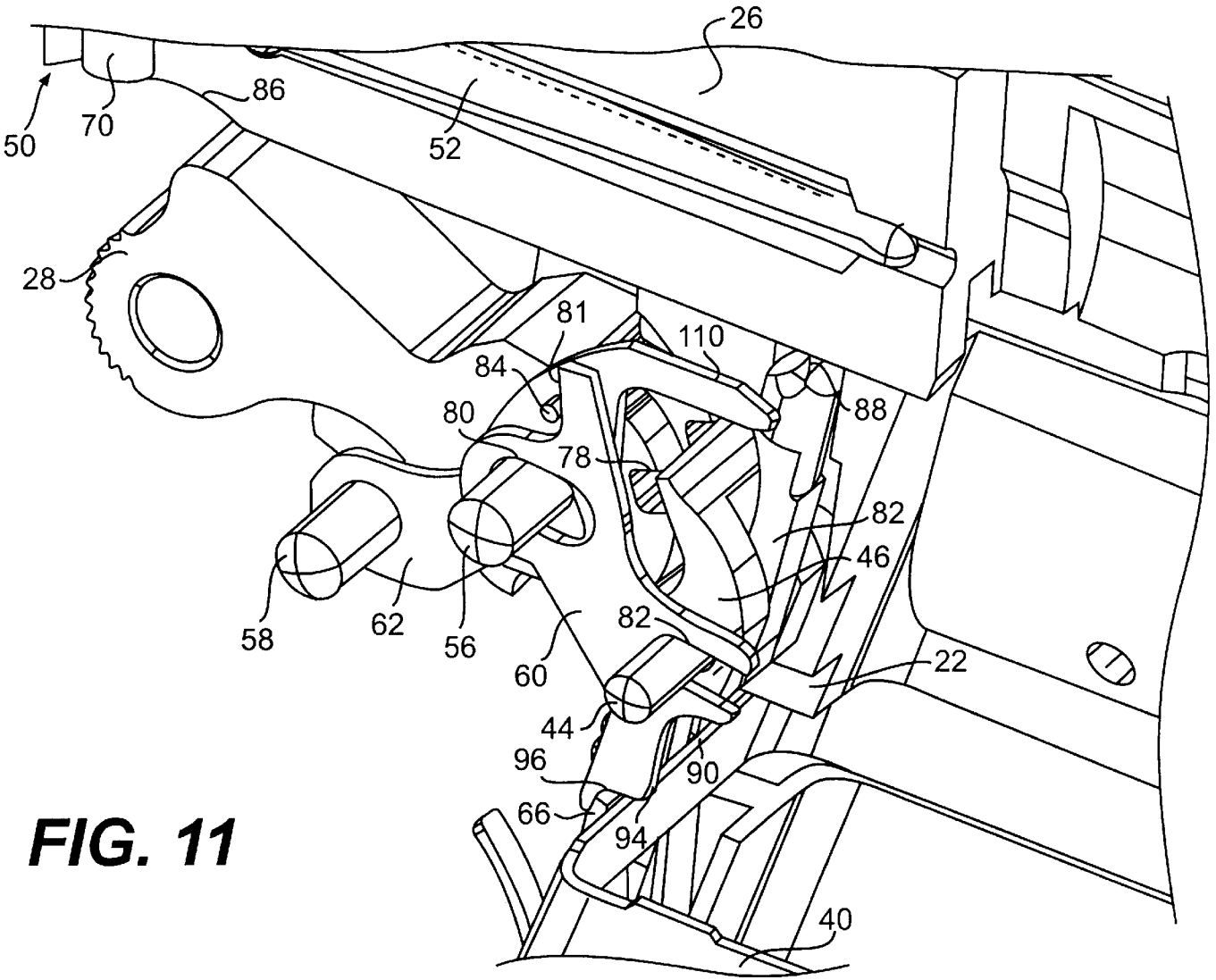
FIG. 11 is a pictorial view of the firing pin locking assembly of FIG. 9, illustrating the recoil position.

As illustrated in FIG. 11, the recoil action of the fired round moves the slide 26 rearwardly on the frame 22. The rearward movement of the slide 26 extracts the spent round and causes the hammer 28 to rotate rearwardly. In addition, the slide cam 86 acts on the slide contact 88, thereby forcing the disconnect member 92 generally downward.

The generally downward motion of the disconnect member 92 causes the paddle 66 to slide along the rear edge 90 of the drawbar and move out of contact with the sear prongs 106 (referring to FIGS. 2 and 8). Because the paddle 66 has moved out of engagement with the sear prongs 106 (referring to FIG. 6), the sear 46 is free to rotate back into contact with the hammer 28. As the slide returns to its forward position, the hammer 28 rotates forward until the sear 46 engages the cocked notch 78.

In addition, the downward motion of the disconnect member causes the paddle 66 to move out of contact with lower edge 94 of slide plate 60. Since the paddle 66 is no longer supporting the slide plate 60, the slide plate 60 is free to move in a generally longitudinal direction between the hammer and sear pins 56 and 44, respectively. Because the slide plate 60 is no longer supporting the plunger lever 62, the downward bias of the plunger spring 54 on lever arm 110 causes the plunger lever 62 to pivot downwardly about the safety pin 58. The downward pivot of the plunger lever 62 allows the plunger spring 54 to urge the firing pin plunger 50 into the locked position as illustrated in FIG. 3. This reverse chain of events leads to automatic locking of the firing pin after each shot is fired, regardless of the trigger position.

Figure 12:
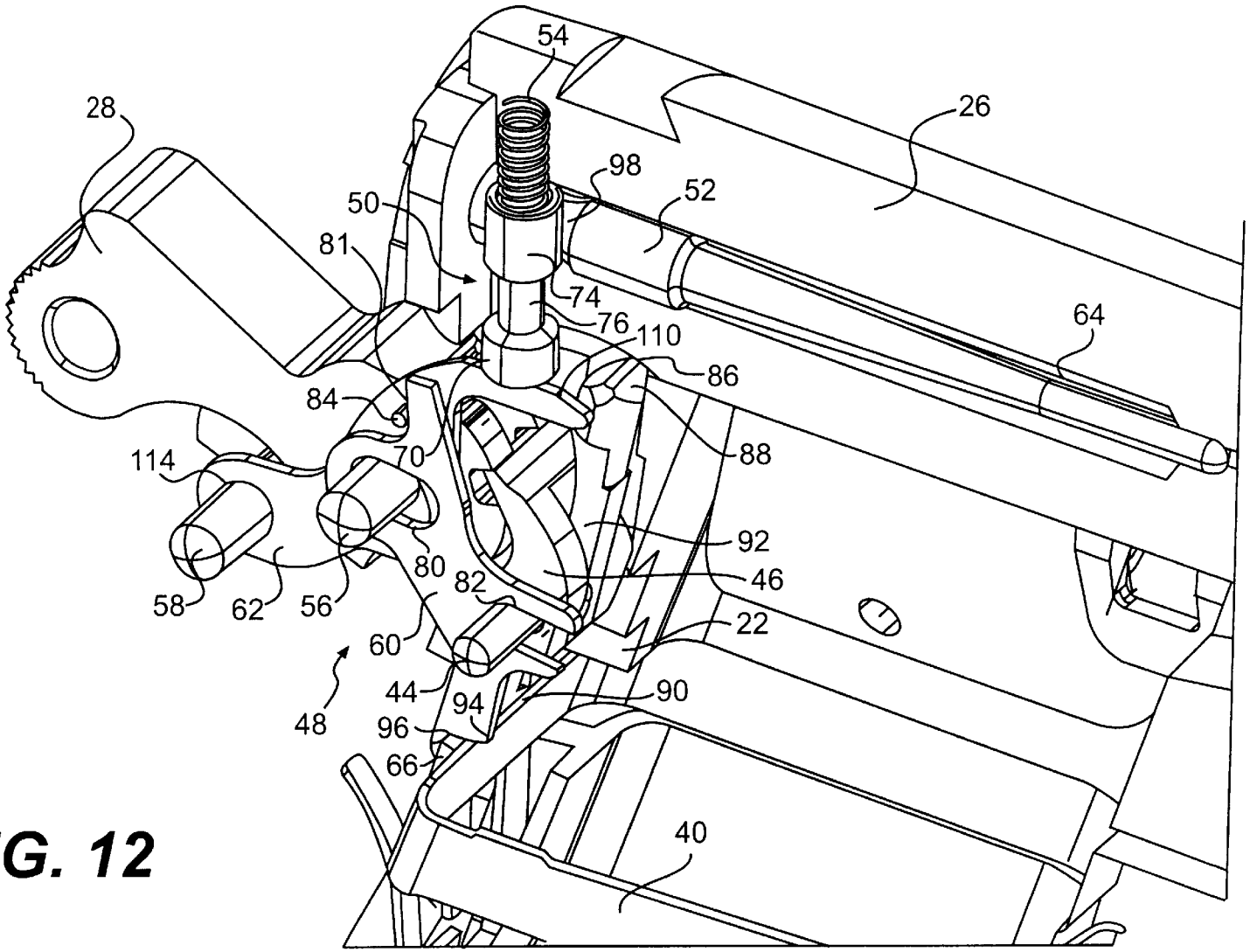
FIG. 12 is a pictorial view of the firing pin locking assembly of FIG. 9, illustrating the disconnected position.

If the trigger 24 is not released after the round is fired, the drawbar 40 will remain in the rearward position. The slide 26 will return to the forward position and chamber the next round. As illustrated in FIG. 12, the firing pin plunger 50 is again positioned over the lever arm 110 of the plunger lever 62. However, because the paddle 66 of the disconnect member 92 is no longer supporting the slide plate 60, the lever arm 110 cannot overcome the bias of the plunger spring 54. The lever arm 110 rotates downwardly and the pin on the plunger lever 62 forces the slide plate 60 forward. Thus, the firing pin plunger 50 returns to the locked position even when the trigger is not released.

By locking the firing pin after each round is fired regardless of the trigger position, the locking mechanism of the present invention prevents accidental firings. If the firing pin were not locked and the gun jammed or otherwise malfunctioned, the gun could possibly enter an automatic state, where rounds are continuously fired until the trigger is released. The disclosed handgun avoids this scenario by locking the firing pin after each round is fired, regardless of the trigger position.

Before the next round can be fired, the trigger 24 should be released. When the trigger 24 is released, the leaf spring 42 will act on the spring contact 68 (referring to FIG. 9) of the disconnect member 92 to return the drawbar 40 and trigger 24 to their forward positions. In addition, when the disconnect member 92 has reached its forward position, the leaf spring 42 biases the disconnect member 92 upwardly until the slide contact 88 contacts the slide cam 86. Thus, the handgun has returned to the cocked position illustrated in FIGS. 2 and 9 and the next round may be fired.

Figure 14:
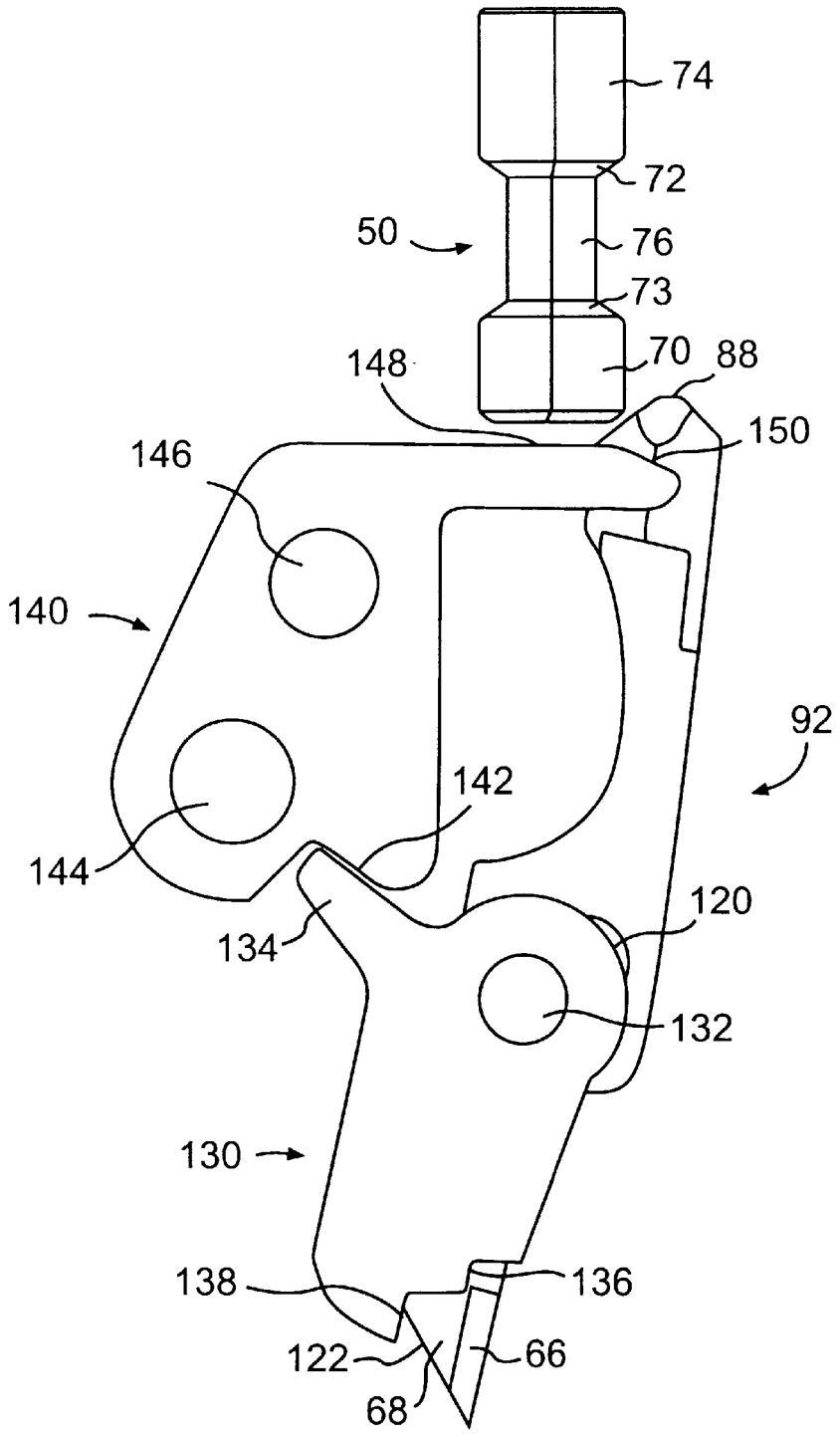
FIG. 14 is a side view of the plunger support of FIG. 13, illustrating a firing pin plunger in the locked position with the trigger in its forward position.

The operation of a second preferred embodiment of the aforementioned device will now be described with reference to FIGS. 13–16. This embodiment differs from the first embodiment by utilizing two pivoting levers, rather than a pivoting lever and a slide plate In this second preferred embodiment and as illustrated in FIG. 14, paddle 66 of disconnect member 92 contacts first lower edge 136 of second lever 130. The rearward motion of trigger 24 and drawbar 40 results in a pivoting motion of second lever 130 about sear pin 44 in a counter-clockwise manner. Support arm 134 acts on support surface 142 of first lever 140 to cause a corresponding pivot of first lever 140 about hammer pin 56.

Figure 15:
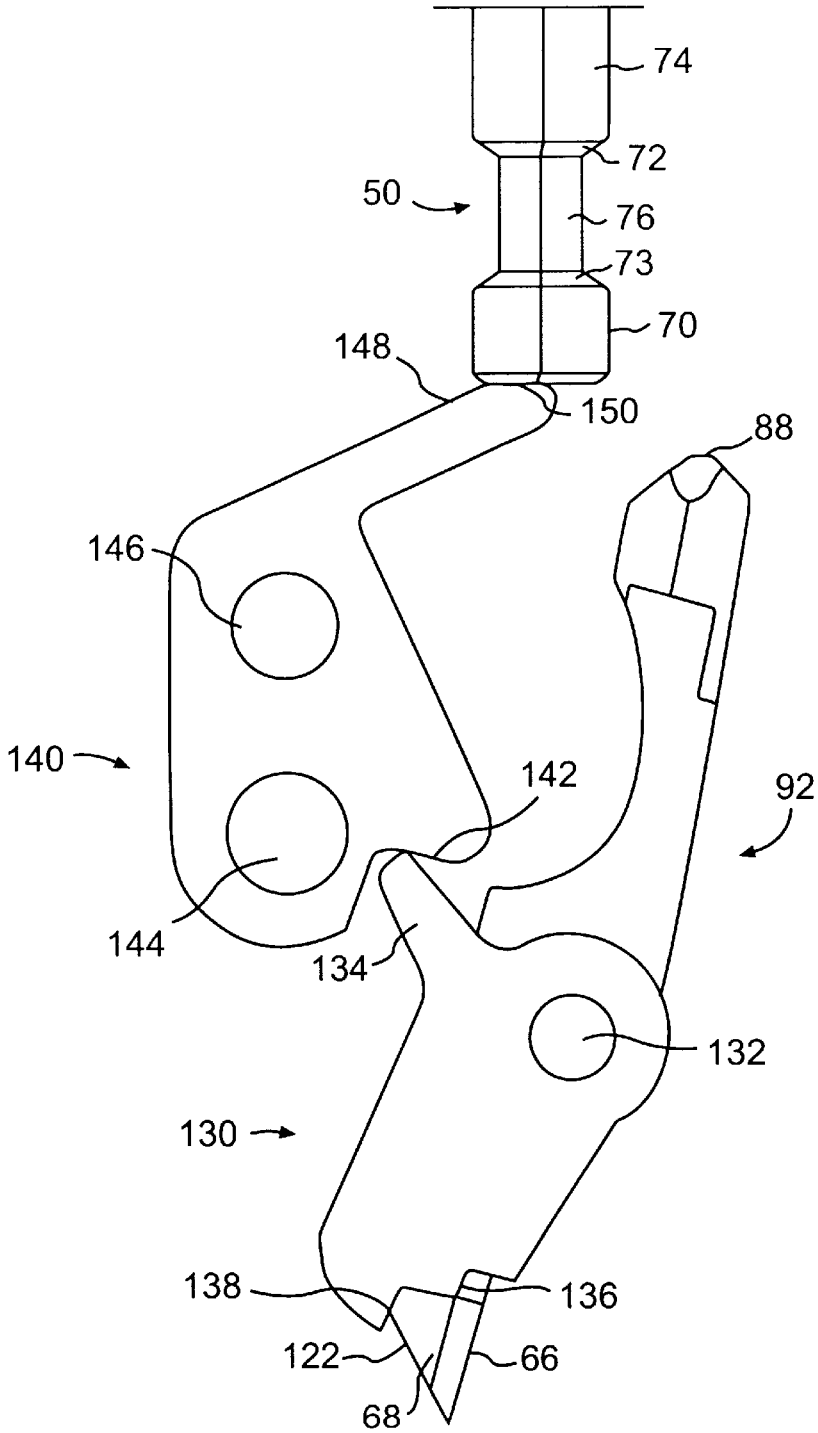
FIG. 15 is a side view of the plunger support of FIG. 13, illustrating the firing pin plunger in the unlocked position after the trigger has been pulled and before the slide recoils.
Figure 16:
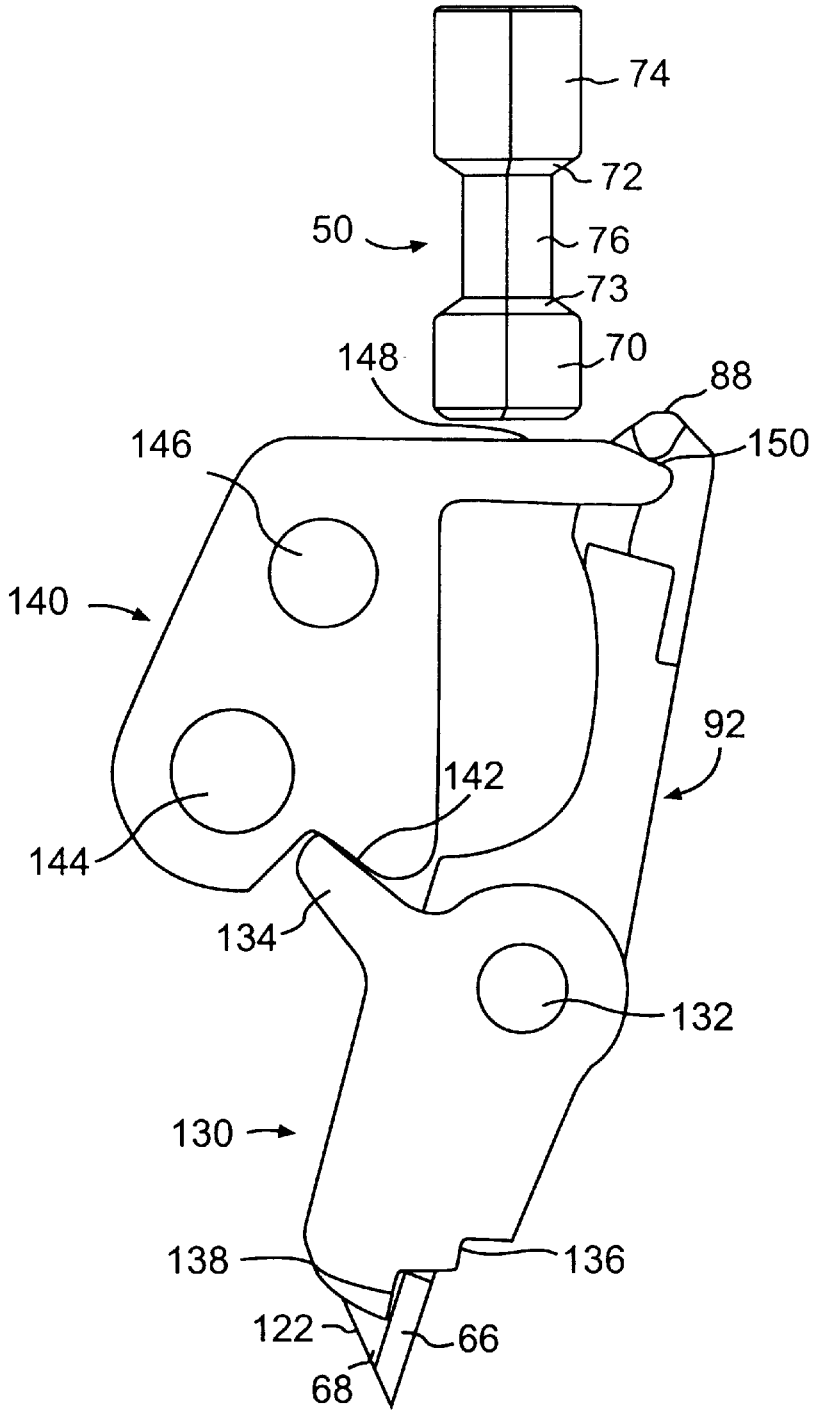
FIG. 16 is a side view of the plunger support of FIG. 13, illustrating the disconnected position after the slide recoils and the disconnect is moved downwardly.

As illustrated in FIG. 15, the pivoting of first lever 140 results in lever arm 148 pivoting upwardly to contact firing pin plunger 50 and move the firing pin plunger to the unlocked position. As previously described, in the unlocked position, firing pin plunger 50 is disengaged from firing pin 52. Thus, firing pin 52 is free to move into contact with a chambered round to fire the round.

The recoil action of the fired shot results in the rearward motion of slide 26, which causes disconnect member 92 to move generally downward. The generally downward motion of disconnect member 92 causes paddle 66 to slide out of contact with first lower surface 136 of second lever 130.

Because paddle 66 is no longer supporting the second lever 130 at first lower edge 136, second lever may pivot in the opposite direction until second lower surface 138 engages paddle 66. The downward bias of plunger spring 54 causes first lever 140 to pivot downwardly about hammer pin 56. The downward pivot of first lever 140 allows firing pin plunger 50 to return to the locked position. Thus, this embodiment also leads to automatic locking of the firing pin after each shot is fired, regardless of the trigger position. This embodiment therefore provides all of the advantages described in connection with the first embodiment. It is contemplated that various combinations of pivoting levers and/or sliding plates may be utilized to provide these same advantages, as long as the operating mechanism provides for automatic locking after the firing of a single round regardless of the trigger position. In this regard, it is further contemplated that the pivot point of the levers can include the hammer pin, safety pin, sear pin, or some other pivot point.

It will be apparent to those skilled in the art that various modifications and variations can be made in the method of manufacture of the present invention and in construction of this semi-automatic handgun without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A semi-automatic handgun, comprising:

a frame having a sear pin, a hammer pin, a safety pin, and a trigger;

a slide slidably mounted on the frame, the slide moveable between a forward and a rear position;

a firing pin slidably disposed in the slide;

a firing pin plunger moveable between a locked position where the firing pin plunger is engaged with the firing pin and an unlocked position where the firing pin plunger is disengaged from the firing pin;

a plunger spring mounted in the slide, the plunger spring biasing the firing pin plunger into the locked position; and a trigger assembly mounted in the frame and operable to move the firing pin plunger to the unlocked position and to hold the firing pin plunger in the unlocked position in response to movement of the trigger, said trigger assembly further operable to release the firing pin plunger to allow the plunger spring to urge the firing pin plunger into the locked position after each round is fired regardless of the position of the trigger.

2. The handgun of claim 1, wherein the trigger assembly includes a disconnect operably connected to the slide, the movement of the slide from the forward position to the rearward position operating to move the disconnect to thereby release the firing pin plunger such that the plunger spring urges the firing pin plunger into the locked position.

3. The handgun of claim 2, wherein the slide has a cam and the disconnect has a slide contact abutting the slide cam, the rearward movement of the slide operating to move the slide contact along the slide cam, thereby operating the disconnect to release the firing pin plunger.

4. The handgun of claim 3, wherein the disconnect has a paddle and the trigger assembly includes a drawbar and a plunger support, the paddle being operatively connected between the drawbar and plunger support such that a downward motion of the paddle operates to disconnect the drawbar from the plunger support to release the firing pin plunger.

5. The handgun of claim 4, further comprising a trigger spring, wherein the trigger spring acts on the paddle of the disconnect such that the drawbar is biased forwardly and the disconnect is biased into contact with the slide cam.

6. The handgun of claim 1, wherein the trigger assembly includes a first lever pivotally disposed on the hammer pin and a second lever pivotally disposed on the sear pin, the first lever operably engaged with the second lever to move the firing pin plunger to the unlocked position.

7. The handgun of claim 1, wherein the trigger assembly includes a plunger lever rotatably mounted on the safety pin and a slide plate mounted for longitudinal movement on the hammer pin and the sear pin.

8. The handgun of claim 7, wherein the slide plate has a cam and the plunger lever has a pin, the longitudinal movement of the slide plate operating to move the pin along the cam such that the plunger lever rotates around the safety pin.

9. The handgun of claim 7, wherein the plunger lever has a lever arm, the lever arm being positioned such that when the plunger lever is rotated, the lever arm contacts the firing pin plunger to disengage the firing pin plunger from the firing pin.

10. The handgun of claim 7, wherein the plunger lever has a slot that engages the hammer pin, the size of the slot defining the range of rotation of the plunger lever.

11. A semi-automatic handgun, comprising:

a frame slidably mounting a trigger, the trigger slidable between a first position and a second position to discharge the handgun;

a slide mounted on the frame for sliding movement;

a firing pin mounted in the slide and operable to contact a chambered round of ammunition to fire the round;

a firing pin plunger moveable between a locked position where the firing pin plunger locks the firing pin and an unlocked position where the firing pin is free to move into contact with the chambered round, the firing pin plunger being normally biased into the locked position; and a trigger assembly operable to selectively disengage the firing pin plunger from the locked position in response to movement of the trigger and to selectively hold said plunger in the unlocked position, said trigger assembly further operable to release the firing pin plunger from the unlocked position in response to movement of the slide subsequent to the firing of the chambered round, thereby locking the firing pin.

12. The handgun of claim 11, wherein the trigger assembly includes a plunger operating mechanism, a disconnect, and a trigger drawbar operably connected to disengage the firing pin plunger, the disconnect being moveable by recoil action of the slide to disrupt said operative connection and thereby allow the firing pin plunger to return to the locked position.

13. The handgun of claim 12, wherein the slide has a cam and the disconnect has a slide contact abutting the slide cam, a rearward movement of the slide operating to move the slide contact along the slide cam, thereby operating the disconnect to allow the firing pin plunger to return to the locked position.

14. The handgun of claim 12, wherein the plunger operating mechanism includes a first lever operably engaged with the firing pin plunger and a second lever operably connected with the disconnect, the first and second levers operably engaged to disengage the firing pin plunger from the locked position in response to a rearward motion of the drawbar.

15. The handgun of claim 12, wherein the plunger operating mechanism includes a slide plate slidably disposed in the frame and operably connected with the disconnect and a plunger lever operably engaged with the firing pin plunger, the slide plate and plunger lever operably engaged to disengage the firing pin plunger from the locked position in response to a rearward motion of the drawbar.

16. The handgun of claim 11, further comprising a plunger spring that acts to bias the firing pin plunger into the locked position.

17. A semi-automatic handgun, comprising:

a frame having a trigger and a drawbar;

a slide mounted on the frame for sliding movement;

a firing pin mounted in the slide and operable to contact a chambered round of ammunition to fire the round;

a firing pin plunger moveable between a locked position where the firing pin plunger locks the firing pin and an unlocked position where the firing pin is free to move into contact with the chambered round;

a plunger operating mechanism operably connected with the firing pin plunger and selectively movable between a safe position and a firing position in response to a movement of the trigger, the movement of the plunger operating mechanism from the safe position to the firing position causing the firing pin plunger to move from the locked position to the unlocked position; and a disconnect operably connected between the drawbar and the plunger operating mechanism, the disconnect being moveable by recoil action of the slide to disrupt said operative connection and thereby allow the plunger operating mechanism to return to the safe position.

18. The handgun of claim 17, wherein the slide has a cam and the disconnect has a slide contact abutting the slide cam, a rearward movement of the slide operating to move the slide contact along the slide cam, thereby operating the disconnect to disrupt said operative connection.

19. The handgun of claim 19, wherein the plunger operating mechanism includes a first lever operably engaged with the firing pin plunger and a second lever operably connected with the disconnect, the first and second levers operably engaged to move the firing pin plunger from the locked position to the unlocked position.

20. The handgun of claim 17, wherein the plunger operating mechanism includes a slide plate slidably disposed in the frame and operably connected with the disconnect and a plunger lever operably engaged with the firing pin plunger, the slide plate and plunger lever operably engaged to move the firing pin plunger from the locked position to the unlocked position.

21. The handgun of claim 17, further comprising a plunger spring that acts on the firing pin plunger to bias the firing pin plunger into the locked position.

* * * * *

UNITED STATES PATENT AND TRADEMARK OFFICE

CERTIFICATE OF CORRECTION

PATENT NO. : 6,256,918 B1
DATED : July 10, 2001
INVENTOR(S) : Atilla Szabo

It is certified that error appears in the above-identified patent and that said Letters Patent is hereby corrected as shown below:

Column 12, claim 19,
Line 13, "claim 19" should read -- claim 17 --.

Signed and Sealed this

Twenty-sixth Day of February, 2002

*Attest:*

*Attesting Officer*

JAMES E. ROGAN
*Director of the United States Patent and Trademark Office*